US008720705B1

(12) United States Patent
Merbeth

(10) Patent No.: US 8,720,705 B1
(45) Date of Patent: May 13, 2014

(54) RIBBON RACK

(71) Applicant: Laura J. Merbeth, Sussex, WI (US)

(72) Inventor: Laura J. Merbeth, Sussex, WI (US)

( * ) Notice: Subject to any disclaimer, the term of this patent is extended or adjusted under 35 U.S.C. 154(b) by 0 days.

(21) Appl. No.: 14/033,834

(22) Filed: Sep. 23, 2013

Related U.S. Application Data

(63) Continuation-in-part of application No. 13/650,343, filed on Oct. 12, 2012.

(51) Int. Cl.

| | |
|---|---|
| ***A47F 7/00*** | (2006.01) |
| ***A47F 5/08*** | (2006.01) |
| ***A47G 29/00*** | (2006.01) |
| ***A47H 13/00*** | (2006.01) |
| ***A47H 1/00*** | (2006.01) |
| ***A47G 1/12*** | (2006.01) |
| ***A47G 25/06*** | (2006.01) |
| ***A47B 97/00*** | (2006.01) |

(52) U.S. Cl.

CPC ..... *A47G 1/12* (2013.01); *A47G 25/0685* (2013.01); *A47B 97/00* (2013.01); *A47F 5/08* (2013.01)

USPC ..... 211/87.01; 211/124; 211/85.3; 211/100

(58) Field of Classification Search

CPC . A47G 1/12; A47G 25/0692; A47G 25/0685; A47G 25/06; A47B 97/00; A47B 61/02; A47F 5/0807; A47F 5/08; A47F 5/0876; A47F 5/0815; A47F 7/024; A47F 5/0861; A47K 10/12; A47K 10/10; A47H 1/02; A47H 1/03; A47H 1/142; D06F 57/12; F16B 45/00; F16B 45/02

USPC ..... 211/123, 124, 105.1, 85.3, 96, DIG. 1, 211/88.04, 7, 4, 119.004, 119.009, 87.01, 211/99, 100, 6, 16, 168, 106.01, 13.1, 85.9, 211/60.1; 248/205.3, 214, 215, 690, 691, 248/301, 303, 305, 306; 312/107.5

See application file for complete search history.

(56) References Cited

U.S. PATENT DOCUMENTS

| | | | | | |
|---|---|---|---|---|---|
| 261,817 | A | * | 7/1882 | Mallory | 211/16 |
| 320,211 | A | * | 6/1885 | Bergsten | 211/16 |
| 323,478 | A | * | 8/1885 | Wineman | 211/88.04 |
| 531,496 | A | * | 12/1894 | Barwick | 281/19.1 |
| 661,557 | A | * | 11/1900 | Schwab | 52/27 |
| 673,412 | A | * | 5/1901 | Baker | 248/262 |
| 778,579 | A | * | 12/1904 | Henderson | 211/16 |
| 1,028,757 | A | * | 6/1912 | Margerison | 160/108 |
| 1,147,019 | A | * | 7/1915 | Henry | 211/7 |
| 1,202,190 | A | * | 10/1916 | Kern | 242/565 |
| 1,324,180 | A | * | 12/1919 | Shupp | 211/7 |

(Continued)

*Primary Examiner* — Jennifer E Novosad

(74) *Attorney, Agent, or Firm* — Donald J. Ersler

(57) ABSTRACT

A ribbon rack includes a retention base and a removable member. The retention base preferably includes an elongated base, a first hook plate and a second hook plate. The first hook plate extends downward from a first end of the elongated base and the second hook plate extends downward from a second end of the elongated base. The first and second hook plates are bent upward to form first and second hook ends. The first and second hook ends are sized to receive the elongated member. At least one figurine preferably extends upward from the elongated base. At least two holes are preferably formed through the elongated base to attach thereof to a flat surface. A second embodiment of the ribbon rack includes the retention base and an offset removable member. A third embodiment of the ribbon rack includes the retention base and an offset pivoting member.

13 Claims, 9 Drawing Sheets

(56) References Cited

U.S. PATENT DOCUMENTS

| | | | | | |
|---|---|---|---|---|---|
| 1,404,240 | A | * | 1/1922 | Shupe | 211/6 |
| 1,432,589 | A | * | 10/1922 | Brazeau | 211/7 |
| 1,575,270 | A | * | 3/1926 | Jankowsky | 211/87.01 |
| 1,799,521 | A | * | 4/1931 | Levine et al. | 211/99 |
| 1,997,490 | A | * | 4/1935 | Hoar | 211/89.01 |
| 2,492,607 | A | * | 12/1949 | Whitney | 211/124 |
| 2,546,720 | A | * | 3/1951 | Brothers | 211/85.3 |
| 2,616,133 | A | * | 11/1952 | Peters | 211/4 |
| D172,842 | S | * | 8/1954 | Scheer et al. | D6/564 |
| 2,929,513 | A | * | 3/1960 | Herzberg | 211/88.04 |
| 2,964,196 | A | * | 12/1960 | Phillips | 211/85.3 |
| 3,023,991 | A | * | 3/1962 | Fisher | 248/205.3 |
| 3,081,882 | A | * | 3/1963 | Magnuson | 211/119.003 |
| 3,739,920 | A | * | 6/1973 | Coblentz et al. | 211/123 |
| 3,853,225 | A | * | 12/1974 | Gegauff | 211/85.3 |
| 3,868,016 | A | * | 2/1975 | Szpur et al. | 206/350 |
| 4,333,575 | A | * | 6/1982 | Wong | 211/118 |
| 4,544,067 | A | * | 10/1985 | Miller | 211/70.6 |
| D289,257 | S | * | 4/1987 | Smith | D8/376 |
| 4,811,852 | A | * | 3/1989 | Kelly | 211/119 |
| 4,874,084 | A | * | 10/1989 | Strausser | 206/231 |
| 5,137,158 | A | * | 8/1992 | Brockway | 211/106.01 |
| 5,630,517 | A | * | 5/1997 | Maznik | 211/70.6 |
| 6,155,523 | A | * | 12/2000 | Pitre | 248/206.5 |
| D438,714 | S | * | 3/2001 | Osborne | D6/316 |
| 6,216,888 | B1 | * | 4/2001 | Chien | 211/87.01 |
| D446,658 | S | * | 8/2001 | Osborne | D6/316 |
| D503,854 | S | * | 4/2005 | Hess | D6/326 |
| D609,518 | S | | 2/2010 | Schofield et al. | |
| 7,726,495 | B1 | | 6/2010 | Merbeth | |
| 7,789,249 | B1 | * | 9/2010 | Merbeth | 211/87.01 |
| D695,532 | S | * | 12/2013 | Goodman et al. | D6/323 |

* cited by examiner

RIBBON RACK

CROSS-REFERENCES TO RELATED APPLICATIONS

This is a continuation-in-part application of Ser. No. 13/650,343 filed on Oct. 12, 2012.

BACKGROUND OF THE INVENTION

1. Field of the Invention

The present invention relates generally to displaying awards and more specifically to a ribbon rack, which displays a plurality of metals by retaining the ribbons of the plurality of metals.

2. Discussion of the Prior Art

There are numerous devices for displaying awards. However, it appears there are far fewer devices for displaying metals with ribbons. U.S. Pat. No. 7,726,495 to Merbeth discloses award racks. U.S. Pat. No. D609,518 to Schofield et al. discloses a ribbon rack. However, Schofield et al. and Merbeth do not teach or suggest a one piece base for retaining a removable member.

Accordingly, there is a clearly felt need in the art for a ribbon rack, which displays a plurality of metals by retaining the ribbons of the plurality of metals with a removable member or a pivoting member.

SUMMARY OF THE INVENTION

The present invention provides a ribbon rack, which displays a plurality of metals by retaining the ribbons of the plurality of metals. The ribbon rack includes a retention base and a removable member. The retention base preferably includes an elongated base, a first hook plate and a second hook plate. The first hook plate extends downward from a first end of the elongated base and the second hook plate extends downward from a second end of the elongated base. The first hook plate is bent upward to form a first hook end and second hook plate is bent upward to form a second hook end. The first and second hook ends are sized to slidably receive a cross section of the elongated member. However, the retention base could also be fabricated from a molded material, such as plastic and the first and second hook ends molded to shape and not bent.

The removable member is an elongated bar. The removable member may have any suitable cross-section, such as rectangular or round. At least one figurine preferably extends upward from the elongated base. The figurine preferably provides a graphical representation of the event participated in to receive the metal retained on the ribbon rack. The figurine and the elongated base are preferably formed from a single piece of material.

At least two holes are preferably formed through the elongated base to attach thereof to a vertical surface, such as a wall with at least two fasteners. However, other attachment devices may also be used, such as double sided tape. In use, the removable member is removed from the first and second hook ends. The removable member is inserted through a ribbon loop of each metal. The removable member is then slipped back into the first and second hook ends.

A second embodiment of the ribbon rack includes the retention base and an offset removable member. The offset removable member includes two opposing ends that are offset inward from a middle portion thereof. A third embodiment of the ribbon rack includes the retention base and an offset pivoting member. The offset pivoting member includes two opposing ends that are offset inward from a middle portion thereof. An end of the offset pivoting member is pivotally retained in one of the hook ends with a fastener or the like.

Accordingly, it is an object of the present invention to provide a ribbon rack, which displays a plurality of metals by retaining the ribbons of the plurality of metals with a removable member.

Finally, it is another object of the present invention to provide a ribbon rack, which displays a plurality of metals by retaining the ribbons of the plurality of metals with a pivoting member.

These and additional objects, advantages, features and benefits of the present invention will become apparent from the following specification.

DETAILED DESCRIPTION OF THE PREFERRED EMBODIMENTS

Figure 1:
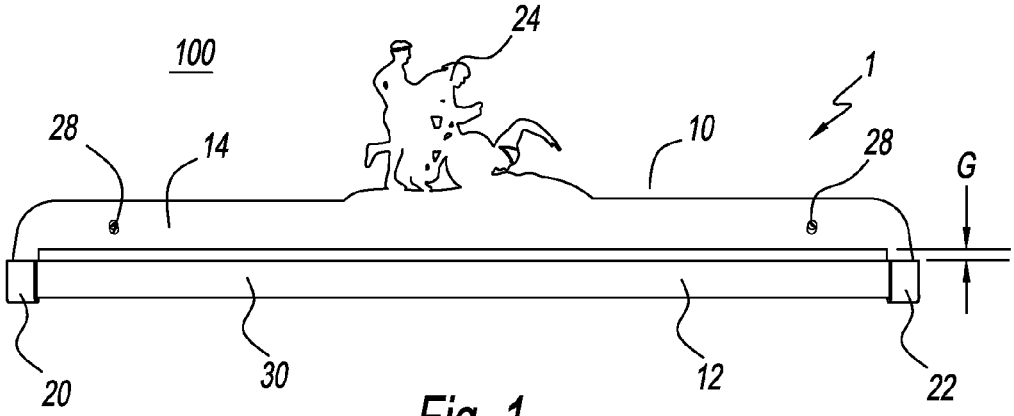
FIG. 1 is a front view of a ribbon rack in accordance with the present invention.
Figure 2:
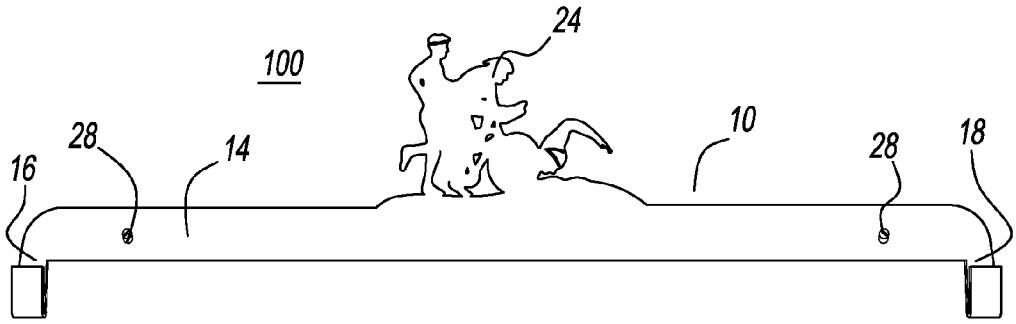
FIG. 2 is a front view of a ribbon rack with a removable member removed in accordance with the present invention.
Figure 3:
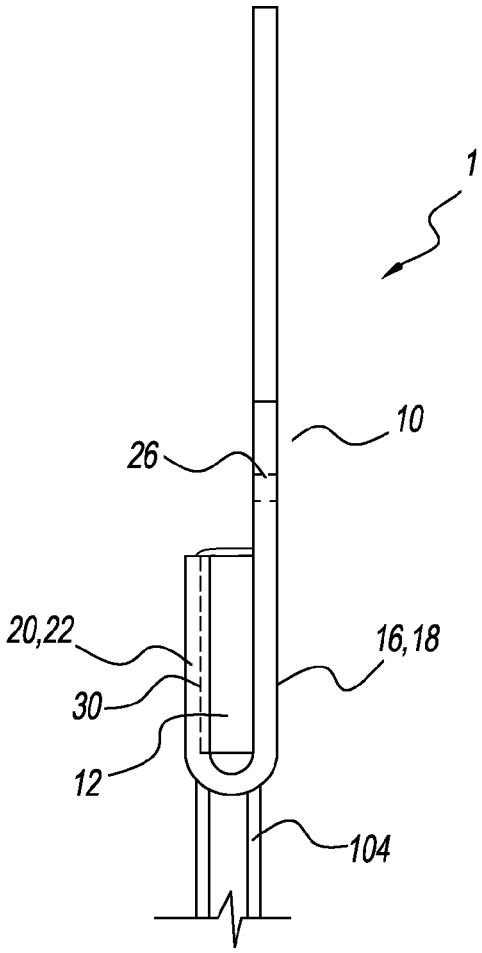
FIG. 3 is an end view of a ribbon rack in accordance with the present invention.
Figure 4:
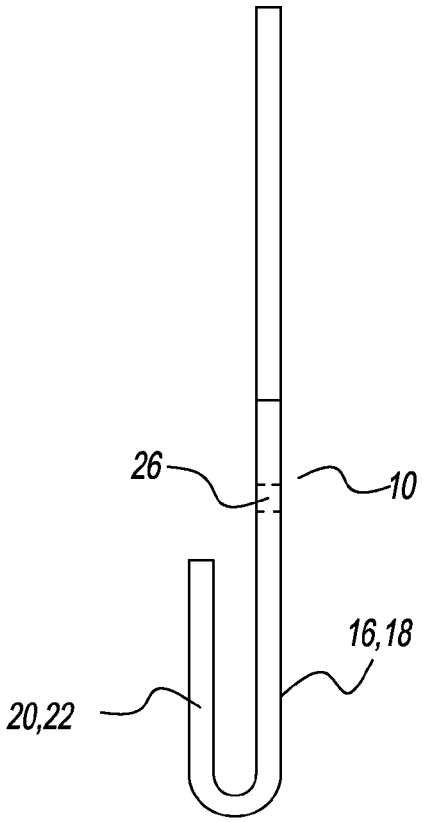
FIG. 4 is an end view of a ribbon rack with a removable rack removed therefrom in accordance with the present invention.

With reference now to the drawings, and particularly to FIG. 1, there is shown a front view of a ribbon rack 1. With reference to FIGS. 2-4, the ribbon rack 1 includes a retention base 10 and a removable member 12. The retention base 10 preferably includes an elongated base 14, a first hook plate 16 and a second hook plate 18. The first hook plate 16 extends downward from a first end of the elongated base 14 and the second hook plate 18 extends downward from a second end of the elongated base 14. The first hook plate 16 is bent upward to form a first hook end 20 and a second hook plate 18 is bent upward to form a second hook end 22. The first hook end 20 includes a first upward facing slot 21. The second hook end 22 includes a second upward facing slot 23. The first and second upward facing slots 21, 23 are sized to slidably receive a cross section of the elongated member 12. The retention base 10 is preferably fabricated from a malleable material, such as steel, but other materials may also be used. However, the retention base 10 could also be fabricated from a molded material, such as plastic and the first and second hook ends molded to shape and not bent. A gap "G" is maintained between a bottom of the elongated base 14 and a top of the removable member 12. The gap "G" is preferably 0.25 inches, but other gap sizes may also be used.

The removable member 12 is an elongated bar. The removable member 12 may have any suitable cross-section, such as rectangular or round. At least one figurine 24 preferably extends upward from the elongated base 10. The figurine 24 preferably provides a graphical representation of the event participated in to receive the metal(s) retained on the ribbon rack 1. The figurine 24 and the removable base 10 are preferably formed from a single piece of material. The at least one figurine 24 is preferably formed with laser cutting device or with a water jet cutter.

Figure 5:
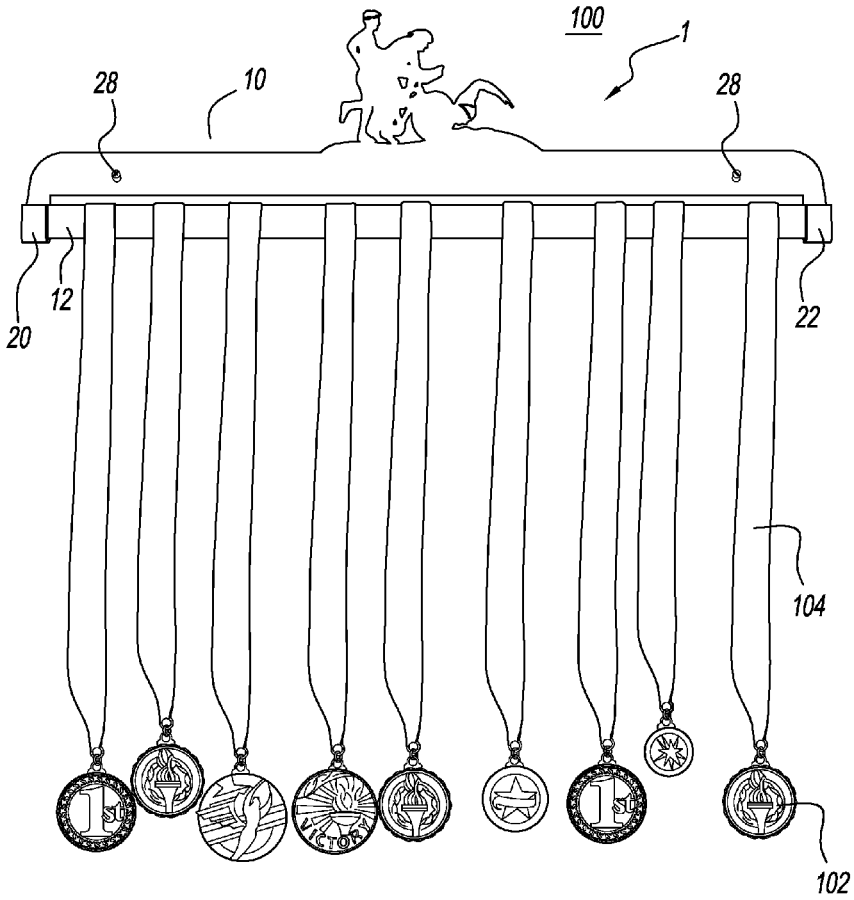
FIG. 5 is a front view of a ribbon rack retaining a plurality of metals by their ribbons in accordance with the present invention.
Figure 6:
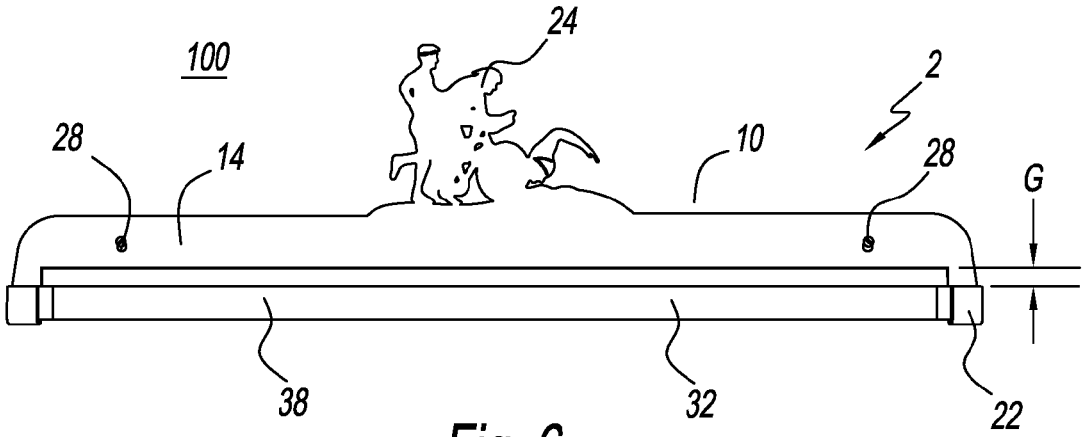
FIG. 6 is a front view of a second embodiment of a ribbon rack in accordance with the present invention.
Figure 7:
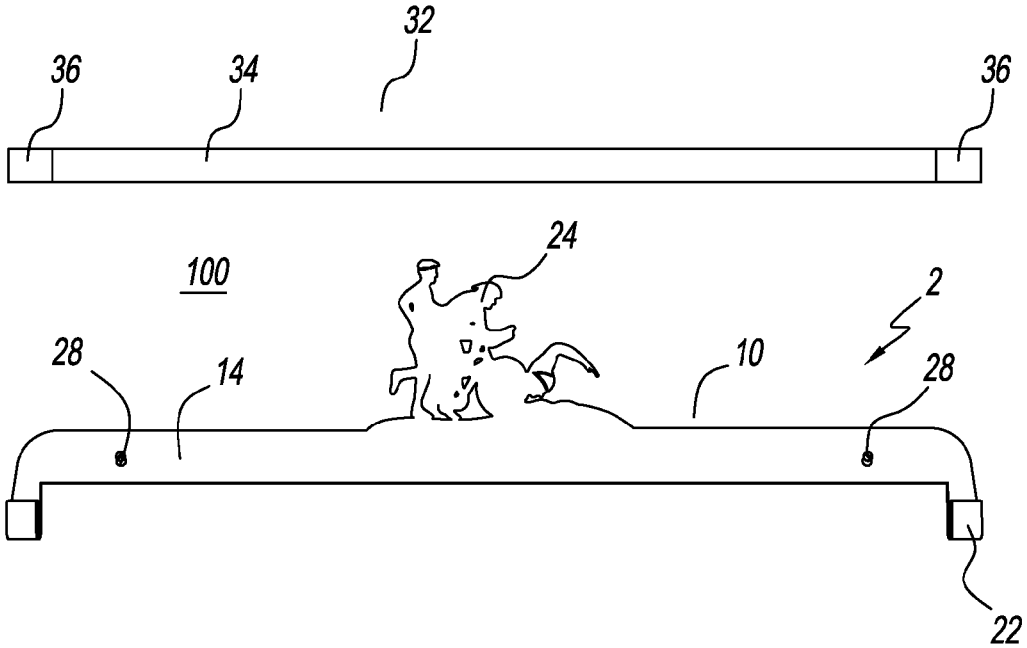
FIG. 7 is an exploded front view of a second embodiment of a ribbon rack in accordance with the present invention.
Figure 8:
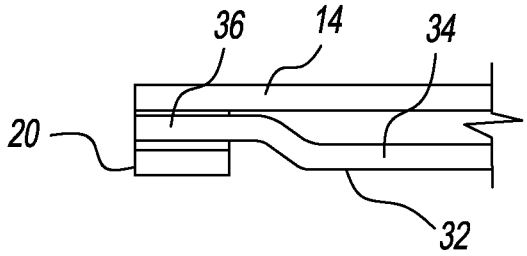
FIG. 8 is a top view of an offset end of an offset removable member retained in a hook end of a second embodiment of a ribbon rack in accordance with the present invention.
Figure 9:
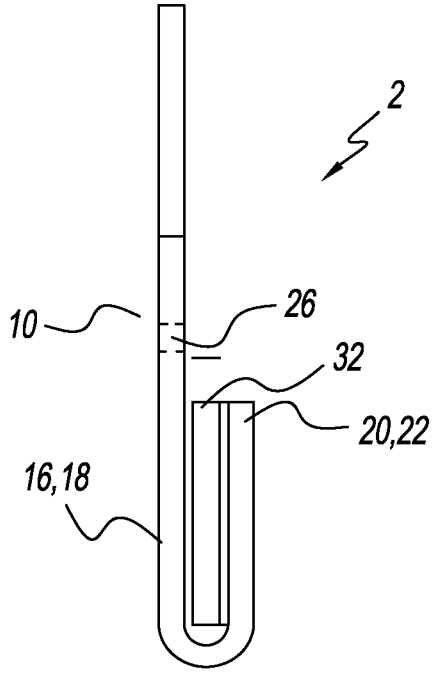
FIG. 9 is an end view of a second embodiment of a ribbon rack in accordance with the present invention.
Figure 10:
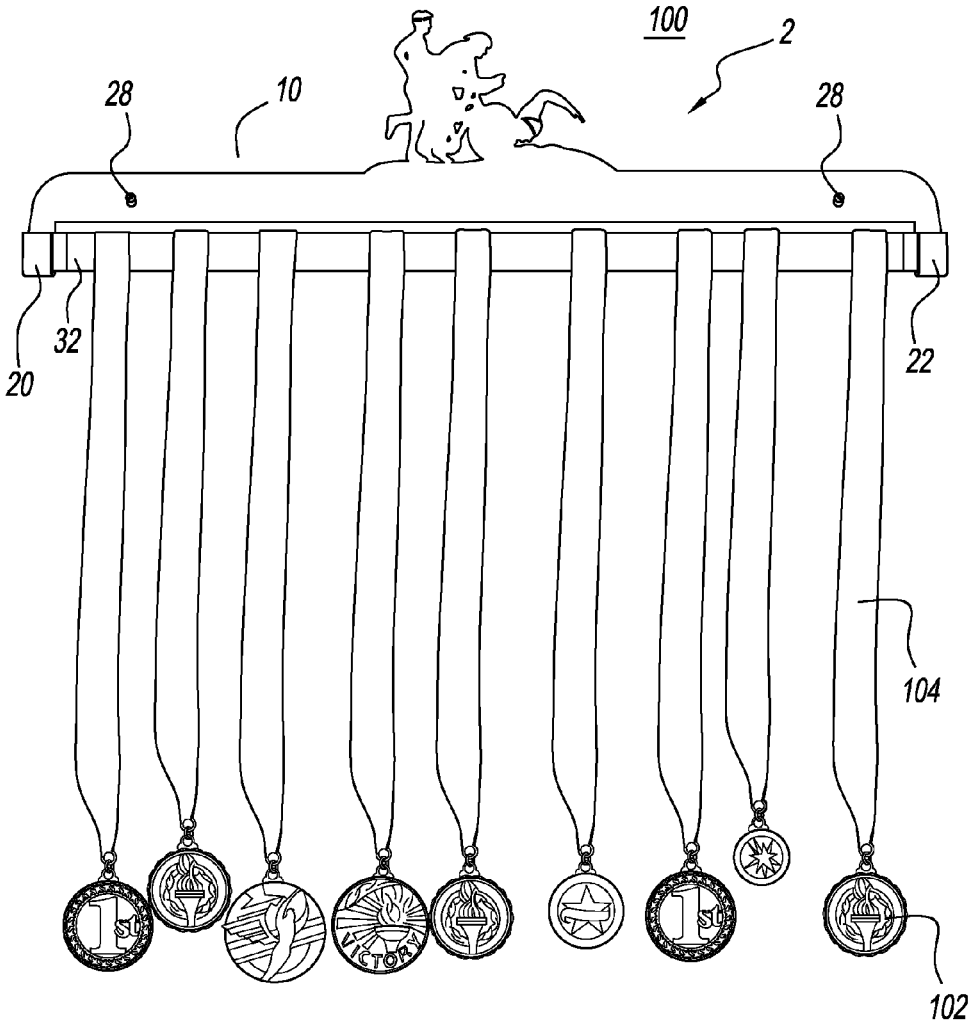
FIG. 10 is a front view of a second embodiment of a ribbon rack retaining a plurality of metals by their ribbons in accordance with the present invention.
Figure 11:
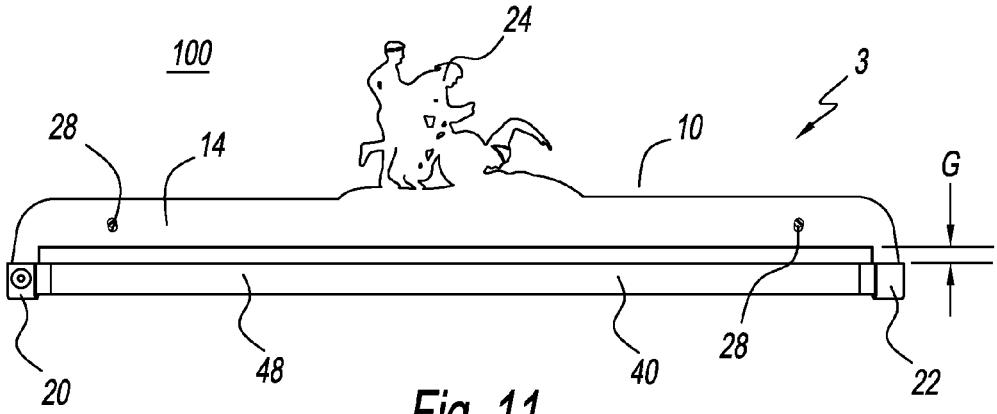
FIG. 11 is a front view of a third embodiment of a ribbon rack in accordance with the present invention.
Figure 12:
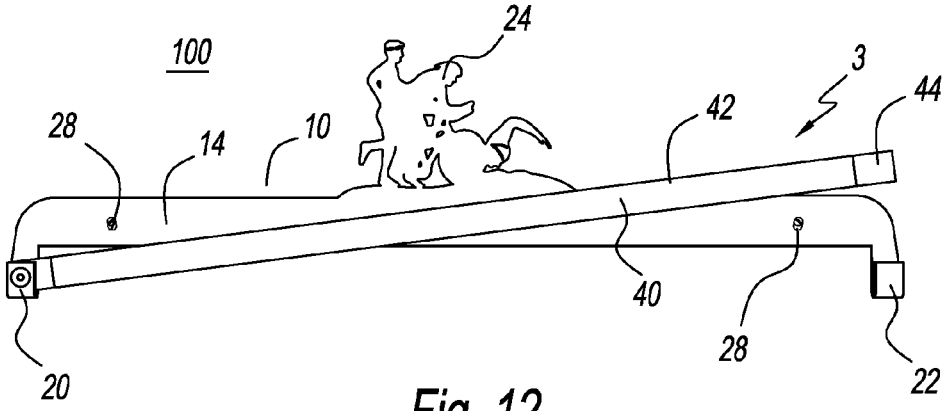
FIG. 12 is a front view of a third embodiment of a ribbon rack with a pivoting offset member rotated out of one of the hook ends in accordance with the present invention.
Figure 13:
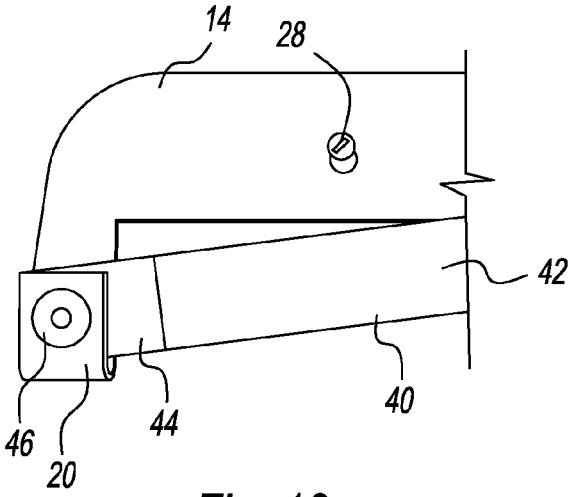
FIG. 13 is an enlarged front view of a third embodiment of a ribbon rack with a pivoting offset member rotated in one of the hook ends in accordance with the present invention.
Figure 14:
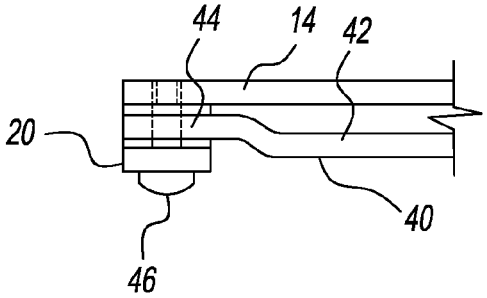
FIG. 14 is an enlarged top view of an offset end of an offset pivoting member retained in a hook end of a third embodiment of a ribbon rack in accordance with the present invention.
Figure 15:
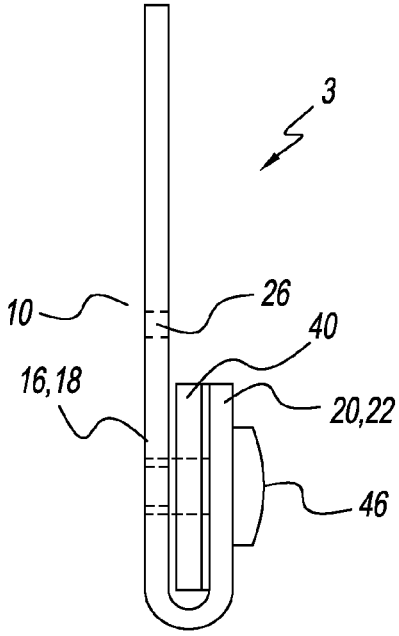
FIG. 15 is an end view of a third embodiment of a ribbon rack in accordance with the present invention.
Figure 16:
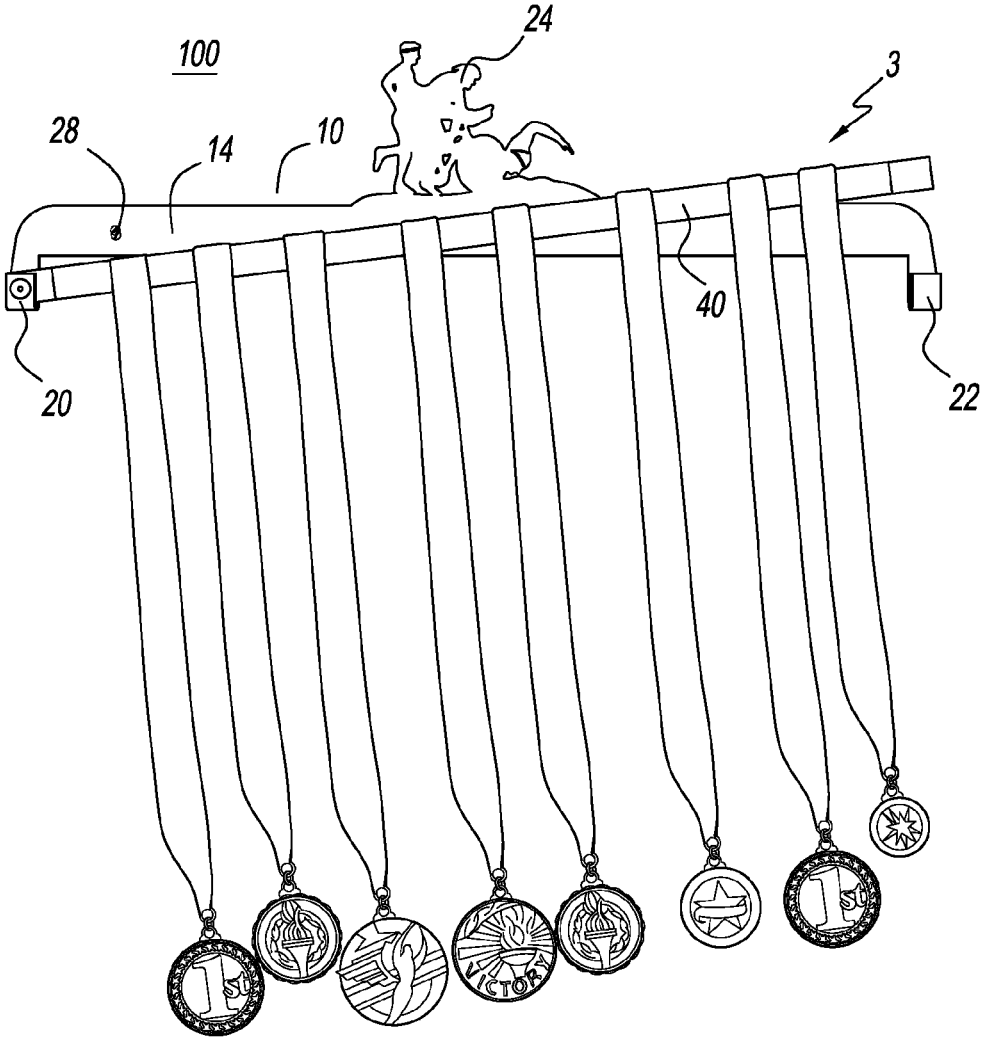
FIG. 16 is a front view of a third embodiment of a ribbon rack retaining a plurality of metals by their ribbons in accordance with the present invention.

At least two holes 26 are preferably formed through the elongated base 10 to attach the ribbon rack 1 to a vertical surface, such as a wall 100 with at least two fasteners 28. With reference to FIG. 5, the removable member 12 is removed from the first and second hook ends. The removable member 12 is inserted through a ribbon loop 104 of each metal 102. The removable member 12 is then slipped back into the first and second hook ends. A thickness of the elongated base 10 is thicker than a thickness of the ribbon 104. However, a metal 102 without a ribbon 104 may be attached to a front of the removable member 12 with double sized tape. The removable member 12 could also be magnetized or a magnetic strip 30 attached to a front of the removable member 12. The magnetic strip 30 may extend an entire length of the removable member 12 or only a portion of the length of the removable member 12.

With reference to FIGS. 6-10, a second embodiment of the ribbon rack 2 includes the retention base 10 and an offset removable member 32. The offset removable member 32 includes a middle portion 34 and two offset ends 36. The two offset ends 36 are offset inward from the middle portion 34 of the offset removable member 32. The offset removable member 32 could also be magnetized or a magnetic strip 38 attached to a front of the offset removable member 32. The magnetic strip 38 may extend an entire length of the offset removable member 32 or only a portion of the length of the offset removable member 32.

With reference to FIGS. 11-16, a third embodiment of the ribbon rack 3 includes the retention base 10 and an offset pivoting member 40. The offset removable member 40 includes a middle portion 42 and two offset ends 44. The two offset ends 44 are offset inward from the middle portion 42. One of the offset ends 44 is pivotally retained in one of the hook ends 20, 22 with a fastener 46 or the like. The offset removable member 40 could also be magnetized or a magnetic strip 48 attached to a front of the offset removable member 40. The magnetic strip 48 may extend an entire length of the offset removable member 40 or only a portion of the length of the offset removable member 40.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A ribbon rack for retaining at least one award comprising:

a removable member having an elongated length;

a retention base having an elongated base, a first hook end and a second hook end, said first hook end is disposed on one end of said elongated base, said second hook end is disposed on an opposing end of said elongated base, said first hook end includes a first upward facing slot, said second hook end includes a second upward facing slot, said first and second upward facing slots are sized to slidably receive a thickness of said removable member, a gap is created between a bottom of said elongated base and a top of said removable member, an end of said removable member is pivotally engaged in one of said first and second upward facing slots, wherein said removable member pivots in a vertical plane relative to said retention base; and at least one figurine extending from said retention base.

2. The ribbon rack for retaining at least one award of claim 1, further comprising:

one of a magnetic strip attached to said removable member and said removable member being magnetized.

3. The ribbon rack for retaining at least one award of claim 1 wherein:

at least two holes are formed through said elongated base.

4. The ribbon rack for retaining at least one award of claim 1 wherein:

said at least one figurine having a graphical representation of an event participated in to receive a metal retained on the ribbon rack.

5. A ribbon rack for retaining at least one award comprising:

a removable member having a middle portion, a first offset end and a second offset end, said first and second offset ends are offset inward from said middle portion;

a retention base having an elongated base, a first hook end and a second hook end, said first hook end is disposed on one end of said elongated base, said second hook end is disposed on an opposing end of said elongated base, said first hook end includes a first upward facing slot, said second hook end includes a second upward facing slot, said first and second upward facing slots are sized to slidably receive a thickness of said first and second offset ends, an end of said removable member is pivotally engaged in one of said first and second upward facing slots, wherein said removable member pivots in a vertical plane relative to said retention base; and at least one figurine extending from said retention base.

6. The ribbon rack for retaining at least one award of claim 5, further comprising:

one of a magnetic strip attached to said removable member and said removable member being magnetized.

7. The ribbon rack for retaining at least one award of claim 5 wherein:

at least two holes are formed through said elongated base.

8. The ribbon rack for retaining at least one award of claim 5 wherein:

said at least one figurine having a graphical representation of an event participated in to receive a metal retained on the ribbon rack.

9. A ribbon rack for retaining at least one award comprising:

a removable member having an elongated length;

a retention base having an elongated base, a first hook end and a second hook end, said first hook end is disposed on one end of said elongated base, said second hook end is disposed on an opposing end of said elongated base, said first hook end includes a first upward facing slot, said second hook end includes a second upward facing slot, said first and second upward facing slots are sized to slidably receive a thickness of said first and second offset ends, an end of said removable member is pivotally engaged in one of said first and second upward facing slots, wherein said removable member pivots in a vertical plane relative to said retention base; and at least one figurine extending from said retention base.

10. The ribbon rack for retaining at least one award of claim 9 wherein:

said removable member having a middle portion, a first offset end and a second offset end, said first and second offset ends are offset inward from said middle portion.

11. The ribbon rack for retaining at least one award of claim 9, further comprising:

one of a magnetic strip attached to said removable member and said removable member being magnetized.

12. The ribbon rack for retaining at least one award of claim 9 wherein:

at least two holes are formed through said elongated base.

13. The ribbon rack for retaining at least one award of claim 9 wherein:

said at least one figurine having a graphical representation of an event participated in to receive a metal retained on the ribbon rack.

* * * * *